US008790147B2

(12) United States Patent
Senn

(10) Patent No.: US 8,790,147 B2
(45) Date of Patent: Jul. 29, 2014

(54) PERSONAL FLOATATION DEVICE SLEEVE

(76) Inventor: Richard Bernard Senn, San Antonio, TX (US)

( * ) Notice: Subject to any disclaimer, the term of this patent is extended or adjusted under 35 U.S.C. 154(b) by 48 days.

(21) Appl. No.: 13/052,185

(22) Filed: Mar. 21, 2011

(65) Prior Publication Data

US 2012/0244767 A1 Sep. 27, 2012

(51) Int. Cl.
*B63C 9/15* (2006.01)
*B63C 9/125* (2006.01)

(52) U.S. Cl.
USPC ..... 441/92

(58) Field of Classification Search
USPC ..... 441/80, 87, 88, 90–97, 122, 123
See application file for complete search history.

(56) References Cited

U.S. PATENT DOCUMENTS 3,754,731 A 8/1973 MacKal et al.
4,671,507 A * 6/1987 Huttner ..... 482/55
5,393,254 A * 2/1995 Ducheshe ..... 441/118
6,394,866 B1 * 5/2002 Brown ..... 441/108
6,568,976 B2 * 5/2003 Anderson et al. ..... 441/80
7,347,757 B1 * 3/2008 Lanthier ..... 441/122
7,854,639 B1 12/2010 Leal et al.
2004/0033740 A1 * 2/2004 Jones ..... 441/122

* cited by examiner

*Primary Examiner* — Daniel V Venne
(74) *Attorney, Agent, or Firm* — Gunn, Lee & Cave, P.C.

(57) ABSTRACT

The personal floatation device (PFD) sleeve presented in this application comprises a sleeve in the form of a strip that can be worn on a swimmer's appendage including leg, calf and arm. The PFD sleeve may be made of a flexible, water resistant material. The PFD sleeve comprises a single compartment wherein a deflated PFD with $CO_2$ cartridge is stored during swimming, and a first and a second connection panel whose major function is to wrap around the appendage of a swimmer using the fastening means on their surfaces. The present invention provides a PFD that is simple, reliable, light-weight, compact and can be inflated and deployed quickly during an emergency to support a swimmer floating on the water but does not affect the swimmer's mobility before it is deployed.

12 Claims, 3 Drawing Sheets

PERSONAL FLOATATION DEVICE SLEEVE

BACKGROUND OF THE INVENTION

1. Field of the Invention

The present invention relates generally to personal floatation devices and, more particularly to a personal floatation device that is deflated and can be worn on a user's appendage while swimming without affecting user's mobility and can be quickly inflated and deployed when the need for use or an emergency arises.

2. Description of Related Art

It does not matter whether a person is a novice or expert in swimming, physically fit or weak, everyone has a limit to their physical endurance or may encounter an emergency after being in the water for a prolonged period of time; they may require some form of assistance to stay afloat for periods beyond such limit. Personal floatation devices (PFDs) are commonly used in recreational water sports as a safety apparatus to prevent accidental death due to drowning. This is primarily achieved through the use of buoyant materials in the PFD which help support the body near the water surface, particularly the head and face of the wearer, so they may float on or near the surface with little or no effort. The PFD may be in the form of a vest with openings for a wearer's neck, arms and waist. A strap with a locking buckle allows the wearer to secure the vest around their torso.

There are mainly two types of PFDs: a PFD made of foam and an inflatable PFD. It is preferred to minimize the bulk of the foam to allow sufficient freedom of arm and shoulder mobility demanded by recreational water sports. However the foam must be of sufficient volume in order to support the weight of an adult, and this requirement generally results in bulkiness of the PFD which many individuals find objectionable. Hard foams are typically used due to their high buoyancy characteristics and low cost. Examples of hard foams include closed cell polyethylene and polypropylene foams. One type of closed cell polypropylene foam is FF2C foam. Hard foam does not conform well to a person's body, and is therefore found to be uncomfortable during use.

Another type of PFD is inflatable which may eliminate some of the objections of the foam PFDs. However, these PFDs typically fit over the head of the user and cover the chest and may be attached at the waist; these types of PFDs are warm especially if worn during the summer time.

Therefore, many users tend to remove the PFD and place them out of reach during their activity, or abstain from wearing the PFD altogether because they find the PFD uncomfortable. It would be desirable to be able to wear a PFD which does not affect the mobility of the user wearing the device.

SUMMARY OF THE INVENTION

The primary object of the invention is to provide a PFD that can be carried by a swimmer while swimming without affecting the mobility of a swimmer before the floatation device is deployed.

The object of the invention is to provide a PFD that does not significantly impact the hydrodynamics of the swimmer before it is deployed.

The object of the invention is to provide a PFD that can be reached and deployed by a swimmer when needed.

The object of the invention is to provide a PFD that is simple and reliable and can be released quickly during an emergency.

The object of the invention is to provide a PFD that can provide sufficient buoyancy to support the swimmer once it is deployed until further assistance has arrived.

The object of the invention is to provide a PFD that is light-weight, compact and easy to carry when the PFD is not deployed.

The PFD sleeve presented in this application comprises a PFD contained in a sleeve that is in the form of a strip and can be worn on a user's appendage including leg, calf and arm. The preferred embodiment is worn on the thigh. The sleeve comprises a single compartment wherein a deflated PFD with at least one $CO_2$ cartridge is stored during swimming; and a first and a second connection panel whose major function is to wrap around a swimmer's appendage using fastening means such as VELCRO® fabric hook-and-loop fasteners on their surfaces where the hooks of each panel of the VELCRO® fabric hook-and-loop fasteners may overlap the loops on that panel.

The PFD may be a life vest or any other inflatable PFD known in the art. When a swimmer encounters a situation, for example, fatigue or cramp, or feels the need for floating assistance, the swimmer can pull the cord on the PFD to trigger the $CO_2$ releasing mechanism; the PFD is inflated by the $CO_2$ cartridge and quickly deployed out of the compartment. The PFD is attached to the sleeve by a tether to prevent the PFD from traveling beyond the swimmer's reach. The PFD sleeve is light-weight (less than one pound) and compact, so it does not weigh down the swimmer. Also it is compact, so it won't affect the swimmer's mobility and hydrodynamics. The PFD sleeve further comprises a fabric hook-and-loop fastener such as VELCRO® hook-and-loop panels to attach the sleeve to the swimmer's appendage.

In one embodiment, the PFD storing compartment is made of a bottom wall, and two top walls. The two top walls partially and loosely overlap each other such that when the gas releasing mechanism is triggered the PFD will be inflated and deployed from the compartment. The two top walls may further comprise a fastening device (such as a VELCRO® fabric hook-and-loop fastener) to attach to each other. The compartment may be made of materials known in the art. The PFD may be any personal floatation device known in the art. The compartment may be any shape but is preferably in a rectangular shape.

When not in use, the PFD sleeve may be folded to make it compact and easy to carry around. This may be done by folding the second connection panel toward the compartment where a PFD is enclosed, and then folding the first connection panel towards the compartment to engage the VELCRO® loops of the first connection panel with the VELCRO® hooks of the second connection panel.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals.

DESCRIPTION OF THE PREFERRED EMBODIMENT

Figure 1:
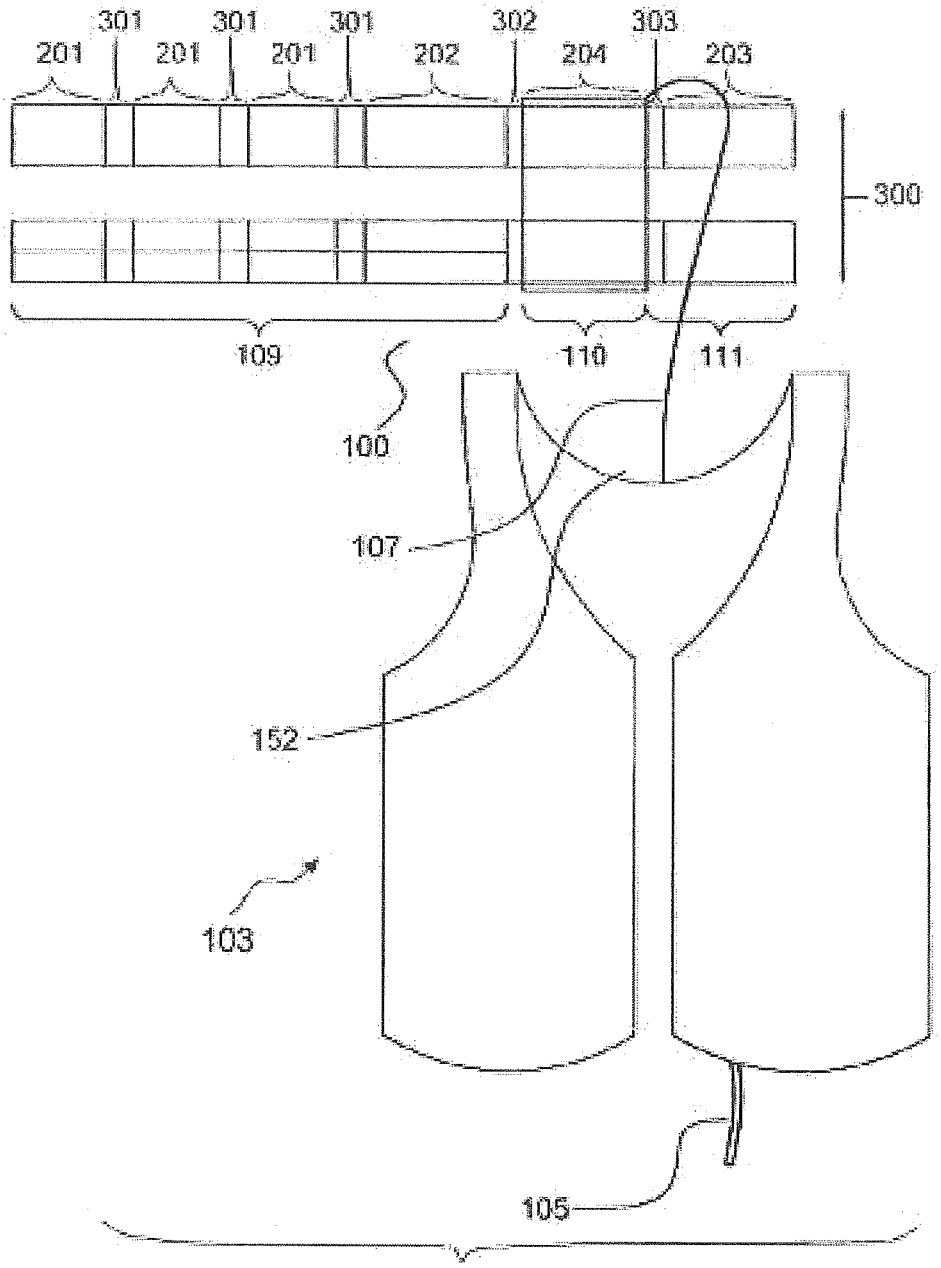
FIG. 1 is a top view of the external surface of a PFD sleeve of the present invention.

The PFD sleeve presented in this application comprises a PFD contained in a sleeve that is in the form of one or two strips. The PFD sleeve 100 has two surfaces, an internal surface facing the human body and an external surface facing the water. In the preferred embodiment, the PFD sleeve 100 includes (1) a strip having a first connection panel 111, a second connection panel 109, and a region 110 between the first connection panel 111 and the second connection panel 109; (2) a compartment 101 attached to the region 110 between the first connection panel 111 and the second connection panel 109 for storing a PFD 103, (3) the PFD 103; and (4) a tether 107 to connect the PFD 103 to compartment 101. FIG. 1 illustrates a top view of the external surface of a PFD sleeve 100. The compartment 101 may be opened and closed to allow access and deployment of PFD 103. The PDF 103 is inflatable by releasing gas stored in a cartridge. Preferably, the PFD 103 is a life vest or jacket. The PFD sleeve 100 may be formed from a flexible, water resistant material or other appropriate material.

Compartment 101 is sewn onto the region 110 of the strip between the second connection panel 109 and the first connection panel 111. The second connection panel 109 and the first connection panel 111 may be flexible or rigid. Additionally, the second connection panel 109 may be substantially rectangular and may be detachably connected to the first connection panel 111 by a fastening means 113 such as a fabric hook-and-loop fastener like VELCRO® (hooks and loops), buttons or other types of fastening devices.

Figure 2:
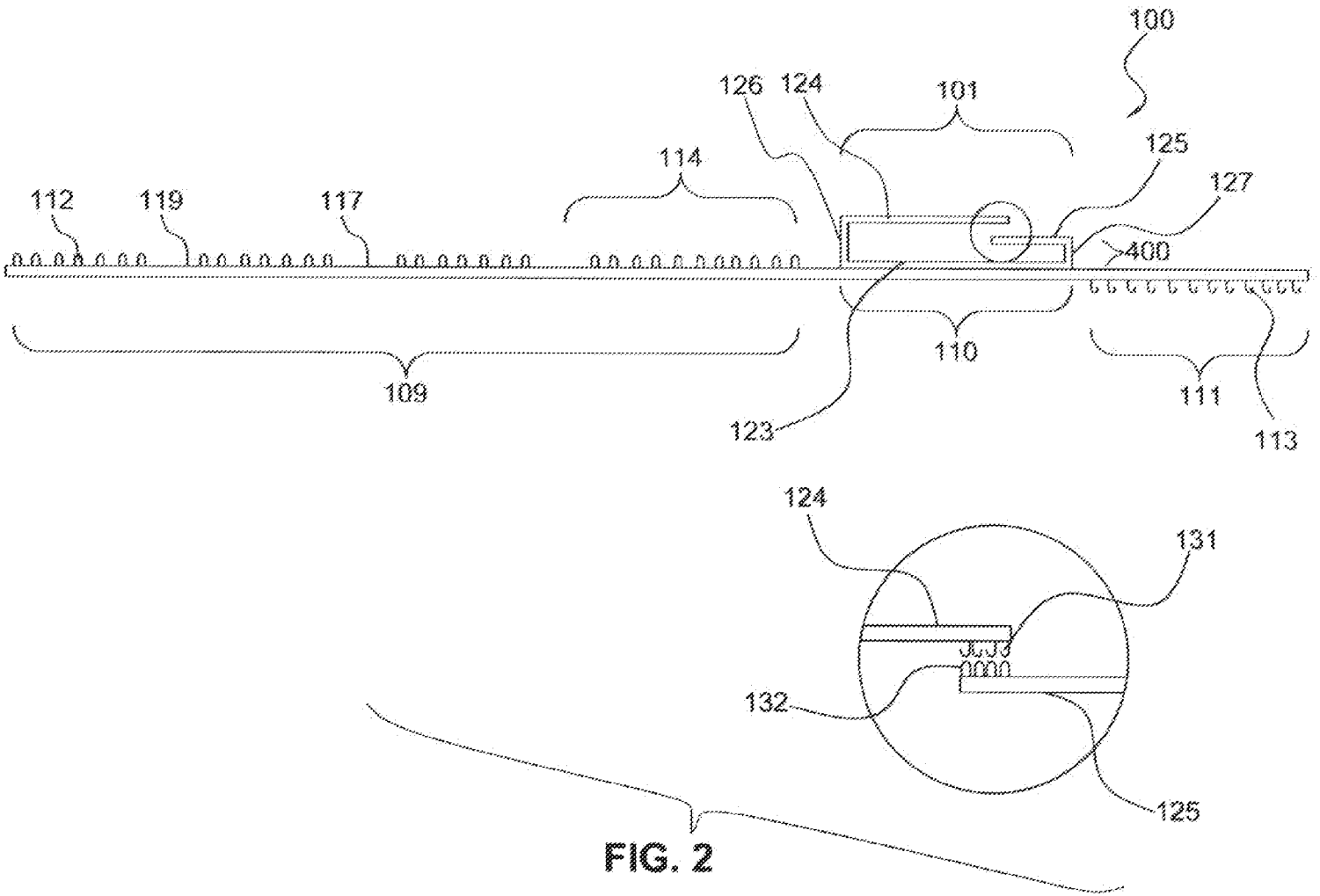
FIG. 2 is a side view of the PFD sleeve wherein the internal surface is on the bottom and the external surface of the PFD sleeve is on the top.

The first connection panel 111 may include a traverse fold line which may extend across the width of the first connection panel 111 to allow the first connection panel 111 to be folded in order to cooperate with the second connection panel 109. Referring to FIG. 2, the external surface 117 of the second connection panel 109 has a VELCRO® fabric hook-and-loop fastener 112 which may be either the hooks or the loops of the fastener 112. The first connection panel 111 may be connected to the compartment 101 on an opposing side with respect to the second connection panel 109 and may include a plurality of fingers which extend outward from the first connection panel 111. The fingers may cooperate with the fingers on the external surface 117 of the second connection panel 109. The present invention may include any number of fingers. Preferably, the first connection panel 111 has a fabric hook-and-loop fastener 113 on the internal surface to engage with the hook-and-loop fastener on the second connection panel 109. In one embodiment, the width (300) of the PFD sleeve 100 is about 6.5 inches.

FIG. 2 illustrates a side view of the PFD sleeve 100 wherein the internal surface (that is the surface facing the human body) is on the bottom and the external surface of the PFD sleeve 100 is on the top. The external surface is made of rubber or oil-resistant synthetic rubber (neoprene). On the second connection panel 109 a layer of VELCRO® loop or hook 112 section is sewn on the external surface 117 while a layer of VELCRO® hook or loop 113 section is sewn on the internal surface of the first connection panel 111.

In an alternative embodiment the hooks of the VELCRO® section may be on the external surface where they at least partially overlap the loops on the internal surface.

Compartment 101 holding the PFD 103 has a bottom wall 123, a first side wall 126, a second side wall 127, and a first top wall 124 partially overlapping a second top wall 125. The bottom wall 123 is sewn on the region 110 between the first connection panel 111 and the second connection panel 109. The first side wall 126 connects the bottom wall 123 to the first top wall 124. The second side wall 127 connects the bottom wall 123 to the second top wall 125. There may be fastener device 131 along the periphery of the interior surface of the first top wall 124 to engage with a fastener device 132 along the opposing periphery of the surface of the second top wall 125. The bottom wall 123, two side walls 126, 127, and two top walls 124, 125 form a neoprene rectangular shape compartment 101 with four sides. The first top wall 124 may be detachably connected to the second top wall 125 in order to release and gain access to the PFD 103. The compartment 101 is illustrated as being substantially rectangular, however other shapes such as circular or oval are within the scope of the present invention. In one embodiment, the thickness of the neoprene strip of the PFD sleeve 100 is about 3 mm.

The second connection panel 109 has four sections of VELCRO® hooks; the length (201) of each of the first three sections is about 3 inches and the last section which is located at the end has a length (202) of about 5 inches. Between each section the gap (301) is about 1 inch. Between the last section of the second connection panel 109 and the compartment 101, the gap (302) is about 0.5 inches. Between the compartment 101 and the first connection panel 111, the gap (303) is about 0.5 inches. The length (203) of the first connection panel 111 is about 5 inches. The compartment 101 is around 0.5 inches tall (400) and 4.5 inches in length (204). The first and second top walls 124 and 125 overlapping region is about 0.75 inches wherein the first top wall 124 comprises VELCRO® hooks or loops and the second top wall 125 comprises VELCRO® loops or hooks to attach to each other.

Figure 3:
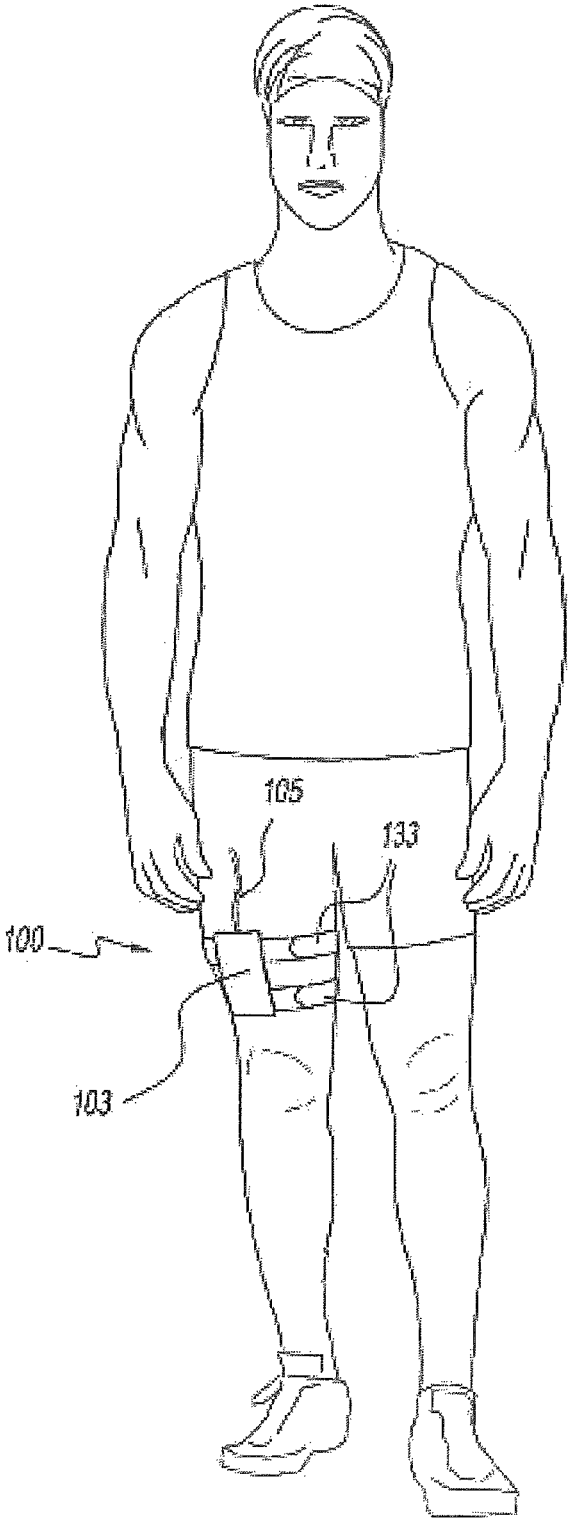
FIG. 3 is a perspective view of the PFD sleeve attached to a user's thigh.

FIG. 3 illustrates a perspective view of the PFD sleeve 100 that is attached to a user's appendage. A cord 105 that can trigger the $CO_2$ releasing mechanism to release $CO_2$ into the PFD 103 is facing up for a user to pull and inflate the PFD 103. The two fingers 133 of the first and second connection panels 109, 111 are folded over to wrap around the user's thigh.

The PFD sleeve 100 may be manufactured and sold independently without the PFD 103. The tether 107 connected to the compartment 101 may contain a hook, for example a snap hook, such that it can be used with other compatible PFD sold in the market.

While there have been shown and described and pointed out the fundamental novel features of the invention as applied to the preferred embodiment, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A personal floatation device (PFD) sleeve which is worn on a swimmer's appendage comprising:

a first strip and a second strip, each of said strips having a first connection panel a second connection panel, and a region between said first and second connection panels;

a compartment extending among and attached to each of the strips, said compartment having an interior, said interior being at least partially defined by a first top wall, a second top wall, and a bottom wall;

an opening into the interior of the compartment between the first top wall and the second top wall;

an inflatable PFD tethered to the compartment, said PFD being insertable through the opening into the interior of the compartment; and, a fastening means for detachably connecting the first and second connection panels of each strip.

2. The PFD sleeve of claim 1 wherein the fastening means comprises a hook-and-loop fastener and, wherein the first and second connection panels of each strip each comprise at least one section of said hook-and-loop fastener.

3. The PFD sleeve of claim 2 wherein the second connection panel of each strip comprises a plurality of sections of the hook-and-loop fastener.

4. The PFD sleeve of claim 1 wherein the bottom wall of the compartment is attached to the region of each strip.

5. A personal floatation device (PFD) sleeve which is worn on a swimmer's appendage comprising:

at least one strip and at most two strips, each strip having an interior surface with a first connection panel, an exterior surface with a second connection panel, and a region between said first and second connection panels;

a compartment attached to the region of each strip, said compartment having an interior, said interior being at least partially defined by a first top wall, a second top wall, and a bottom wall, said first top wall partially overlapping said second top wall;

an opening into the interior of the compartment between the first top wall and the second top wall, said opening being generally transverse to each strip;

an inflatable PFD tethered to the compartment, said PFD being insertable through the opening into the interior of the compartment; and, a fastening means for detachably connecting the first and second connection panels of each strip.

6. The PFD sleeve of claim 5 wherein the fastening means comprises a hook-and-loop fastener and, wherein the first and second connection panels of each strip each comprise at least one section of said hook-and-loop fastener.

7. The PFD sleeve of claim 6 wherein the second connection panel of each strip comprises a plurality of sections of the hook-and-loop fastener.

8. The PFD sleeve of claim 5 wherein the bottom wall of the compartment is attached to the region of each strip.

9. A personal floatation device (PFD) sleeve which is worn on a swimmer's appendage comprising:

a compartment having an interior, said interior being at least partially defined by first top wall, a second top wall, and a bottom wall, said first top wall partially overlapping said second top wall;

an opening into the interior of the compartment between the first top wall and the second top wall;

an inflatable PFD tethered to the compartment, said PFD being insertable through the opening into the interior of the compartment;

a first connection panel and a second connection panel connected to opposing sides of the compartment; and, a fastening means for detachably connecting the first connection panel to the second connection panel, wherein said opening is generally transverse to said first and second connection panels.

10. The PFD sleeve of claim 9 wherein the fastening means for detachably connecting the first connection panel to the second connection panel is a hook-and-loop fastener and, wherein an internal surface of said first connection panel has at least one section of said hook-and-loop fastener and an external surface of said second connection panel has at least one section of said hook-and-loop fastener.

11. The PFD sleeve of claim 10 wherein the external surface of the second connection panel has a plurality of sections of the hook-and-loop fastener.

12. The PFD sleeve of claim 9 further comprising a strip connecting the first and second connection panels to the compartment, said strip having a region between said first and second connection panels and, wherein said compartment is attached to said strip at said region.

* * * * *